US011591892B2

(12) United States Patent
Williamson, Jr. et al.

(10) Patent No.: US 11,591,892 B2
(45) Date of Patent: Feb. 28, 2023

(54) SHUTTLE VALVE ASSEMBLY FOR GAS COMPRESSION AND INJECTION SYSTEM

(71) Applicant: Halliburton Energy Services, Inc., Houston, TX (US)

(72) Inventors: Jimmie Robert Williamson, Jr., Carrollton, TX (US); Joseph Steven Grieco, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 547 days.

(21) Appl. No.: 16/301,702

(22) PCT Filed: Jun. 3, 2016

(86) PCT No.: PCT/US2016/035620

§ 371 (c)(1),
(2) Date: Nov. 14, 2018

(87) PCT Pub. No.: WO2017/209759

PCT Pub. Date: Dec. 7, 2017

(65) Prior Publication Data

US 2019/0218900 A1 Jul. 18, 2019

(51) Int. Cl.
*E21B 43/38* (2006.01)
*E21B 34/08* (2006.01)

(52) U.S. Cl.
CPC ..... *E21B 43/385* (2013.01); *E21B 34/08* (2013.01); *E21B 43/38* (2013.01)

(58) Field of Classification Search
CPC ..... E21B 43/385; E21B 34/08; E21B 43/38
See application file for complete search history.

(56) References Cited

U.S. PATENT DOCUMENTS 4,846,272 A 7/1989 Leggett
6,035,880 A 3/2000 Gazda
(Continued)

FOREIGN PATENT DOCUMENTS

GB 2411416 8/2005
WO 2009097869 A1 8/2009

OTHER PUBLICATIONS

Chen, Kun, Xiang Wei Zeng, and Xiao Ping Qiu. "Shuttle-type Passive Control System for Pressure Pipeline Conveying." Advanced Materials Research. vol. 328. Trans Tech Publications, 2011.
(Continued)

*Primary Examiner* — Michael R Wills, III
*Assistant Examiner* — Neel Girish Patel
(74) *Attorney, Agent, or Firm* — Barnes & Thornburg, LLP

(57) ABSTRACT

A gas separation and injection system includes a lower separator that receives and separates a production stream into higher and lower density streams, a turbine-compressor including a turbine that receives the lower density stream to rotate a shaft that drives a compressor and subsequently recombines the lower and higher density streams into a recombined production stream. An upper separator receives the recombined production stream and includes a gas inlet tube that conveys a gas stream to the compressor to produce a compressed gas stream. A shuttle valve assembly axially interposes the upper separator and the turbine-compressor and includes a mandrel assembly received within a body and having the gas inlet tube extending within the mandrel assembly, a valve seat secured to the gas inlet tube, a piston movably arranged within the inner annulus between closed and open positions, and a shuttle valve operatively coupled to the piston.

21 Claims, 3 Drawing Sheets

(56) References Cited

U.S. PATENT DOCUMENTS

| | | | | |
|---|---|---|---|---|
| 6,260,619 | B1 | 7/2001 | Svedeman et al. | |
| 6,367,551 | B1 | 4/2002 | Fenton | |
| 7,134,488 | B2 | 11/2006 | Tudor et al. | |
| 7,347,270 | B2 | 3/2008 | McMillan et al. | |
| 7,493,967 | B2 | 2/2009 | Mock et al. | |
| 7,784,549 | B2 | 8/2010 | Balen | |
| 8,393,403 | B2 * | 3/2013 | de Boer | E21B 21/10 166/386 |
| 8,590,629 | B2 | 11/2013 | Swietlik et al. | |
| 8,746,350 | B2 | 6/2014 | Bryson | |
| 2002/0174982 | A1 | 11/2002 | Weingarten | |
| 2003/0221827 | A1 * | 12/2003 | Brady | E21B 43/34 166/265 |
| 2009/0084263 | A1 | 4/2009 | Obrejanu | |
| 2012/0227982 | A1 | 9/2012 | Swietlik et al. | |
| 2016/0290100 | A1 * | 10/2016 | Williamson, Jr. | E21B 34/10 |

OTHER PUBLICATIONS

International Search Report and Written Opinion dated Feb. 10, 2017; International PCT Application No. PCT/US2016/035620.

* cited by examiner

SHUTTLE VALVE ASSEMBLY FOR GAS COMPRESSION AND INJECTION SYSTEM

BACKGROUND

During the extraction of hydrocarbons from wells in the oil and gas industry, large volumes of gas are sometimes produced concurrently with crude oil and other formation fluids (e.g., water). Since the gas and oil are commingled and are produced to the surface as a single production stream, large and expensive equipment is typically required at the surface to separate these fluid components before either can be further processed and/or provided to market.

To reduce the size of the equipment and the related costs involved in separating large volumes of gas from a production stream, various methods and systems have been proposed wherein some of the separating/handling steps normally required at the surface are carried out downhole before the production stream reaches the surface. These methods involve separating at least a portion of the gas from the production stream downhole, and then handling the separated gas and the remainder of the production stream separately.

One such method involves positioning an auger separator downhole to separate a portion of the gas from the production stream as the production stream flows upward through the auger separator. The remainder of the production stream and the separated gas are each flowed to the surface through separate flowpaths, where each is individually handled. This type of auger separator now commonly forms an integral part of downhole gas-separation systems, often referred to as subsurface processing and reinjection compressor systems (SPARC). In some SPARC systems, an auger separator is used to separate at least a portion of the gas from the production stream, which, in turn, is then recompressed downhole with an associated compressor and subsequently injected into an adjacent subterranean formation without ever producing the separated gas to the surface. Other SPARC systems utilize an auger separator to separate and compress a portion of the gas in the production stream, but instead of re-injecting the compressed gas, both the compressed gas and the remainder of the production stream are produced to the surface through separate flowpaths.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole gas separation, compression, and reinjection operations and, more particularly, to a shuttle valve assembly that allows a production stream to initially bypass a turbine-compressor unit during start-up of production operations.

Embodiments of the present disclosure describe a shuttle valve assembly used in conjunction with a subsurface processing and reinjection compressor (SPARC) system. In using a SPARC system, a production well is initially shut in at the surface. As the surface valves are opened to allow flow through the SPARC system, gas and production stream mixture must be routed through a dedicated flow path until the speed of the separator(s) increases enough to separate the gas from the liquids. When a predefined pressure differential is attained, the flow path must change to circulate the separated compressed gas through a reinjection path and allow the remaining production stream to be produced to the surface. Conventional SPARC systems employ a heavy spring loaded valve and a large quantity of radially installed spring loaded check valves to change the circulation path. Such conventional components can damage the compressor in the SPARC system during the startup or shut down procedures since one or both of the switching valves could be closed.

The shuttle valve assembly of the present disclosure allows a smoother transition from one operational phase to another without causing damage to the compressor or turbine of the SPARC system during startup or shut down operations. The shuttle valve assembly may be configured to transition between a circulation mode or position, where a compressed gas stream received from the compressor is diverted back into the production stream, and a production mode or position, where the compressed gas stream is sufficiently pressurized to be injected into a surrounding subterranean formation. Transition between each mode may be driven by pressure differential, which may be controlled, for example, by the size of the circulation ports used in the circulation mode. A biasing device may also be included in the shuttle valve assembly to urge the shuttle valve assembly to the circulation mode until sufficient pressure is achieved. The spring rate of the biasing device may vary depending on the desired conditions to transition from one mode to the other. Upon equalization of the pressure where the production stream flow is stopped, the shuttle valve assembly may be configured to revert to its natural state of circulation mode.

Figure 1:
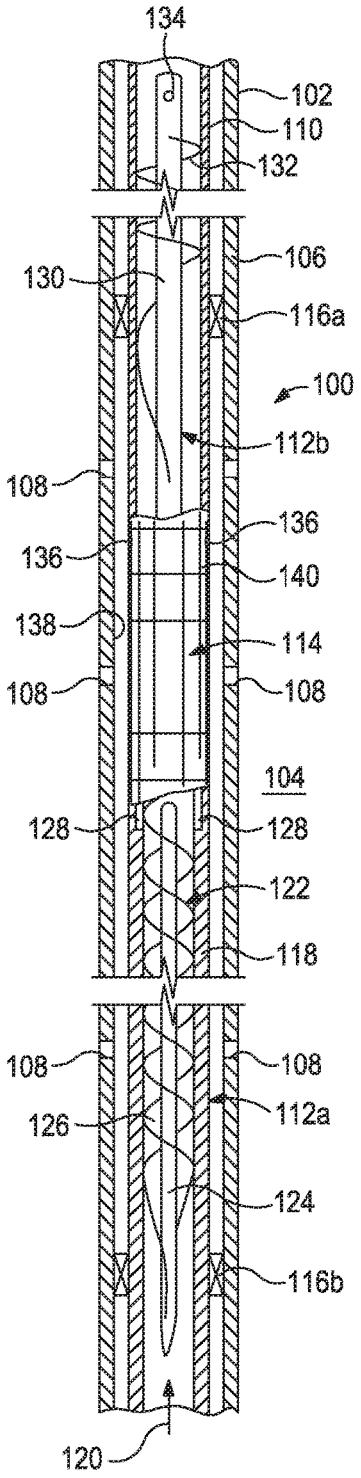
FIG. 1 is a partial cross-sectional view of an exemplary gas separation and injection system.

Referring to FIG. 1, illustrated is a partial cross-sectional side view of an exemplary gas separation and injection system 100, according to one or more embodiments. As illustrated, the gas separation and injection system 100 (hereafter the "system 100") may be conveyed into a wellbore 102 that extends from a surface location (not shown) and through one or more production zones 104, each of which may comprise a hydrocarbon-bearing subterranean formation that is penetrated by the wellbore 102. In at least one embodiment, the production zone 104 may comprise a gas cap located above a hydrocarbon-producing formation. In the illustrated embodiment, the wellbore 102 is lined with a string of casing 106, which may be perforated to provide one or more flow ports 108 that facilitate fluid communication between the production zone 104 and the wellbore 102, as will be understood by those skilled in the art.

While the section of the wellbore 102 in FIG. 1 is depicted as substantially vertical and cased, it will be recognized that the principles of the present disclosure can equally be used in open-hole and/or underreamed completions as well as in inclined and/or horizontal wellbores, without departing from the scope of the disclosure. Moreover, the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The system 100 may include an elongate body 110 that houses the several components of the system 100 and that may be introduced and otherwise conveyed into the wellbore 102 on a conveyance (not shown). In some embodiments, the conveyance may comprise production tubing or coiled tubing lowered into the wellbore 102 from the surface to a target location adjacent the production zone 104. In other embodiments, however, the conveyance may include other types of downhole conveyance means including, but not limited to, wireline or slickline, and the system 100 may be run below a retrievable packer and located on a tubing anchor assembly attached to the retrievable packer.

In one or more embodiments, the system 100 may comprise a subsurface processing and reinjection compressor (SPARC) system. More particularly, the system 100 may include a first or lower separator 112*a*, a second or upper separator 112*b*, and a turbine-compressor 114 that axially interposes the lower and upper separators 112*a, b*. Upper and lower packers 116*a* and 116*b* may be spaced between the system 100 and the casing 106 and the flow ports 108 may be located axially between the upper and lower packers 116*a, b*.

The lower separator 112*a* may include a housing 118 that is fluidly connected to the lower or distal end of the body 110. The housing 118 may be configured to receive the flow of a production stream 120 as it flows upward through the wellbore 102. The lower separator 112*a* may further include an auger separator 122 positioned within the housing 118 and adapted to impart spin to the incoming production stream 120 as it flows therethrough. As shown, the auger separator 122 may include a central rod or support 124 having a helical-wound, auger flight 126 secured thereto. The auger flight 126 is adapted to impart swirl to the production stream 120 to separate heavy liquids and particulate material from the production stream 120 as it flows upward through the lower separator 112*a*. In some embodiments, the auger housing 118 may define and otherwise provide one or more slots 128 in the wall thereof for a purpose described below.

Figure 2:
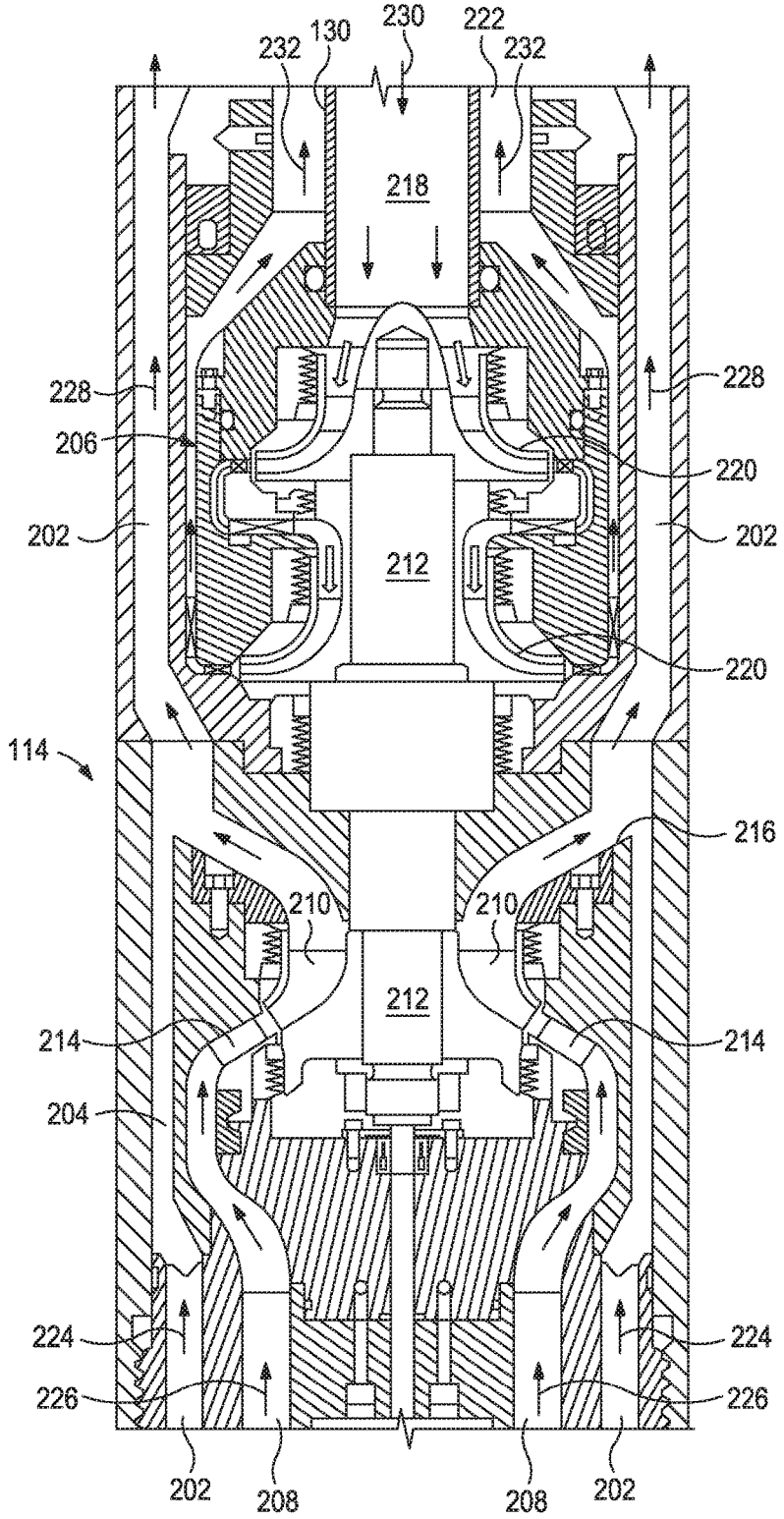
FIG. 2 depicts an enlarged view of the turbine-compressor of FIG. 1.

Referring now to FIG. 2, with continued reference to FIG. 1, the slots 128 of FIG. 1 may open into and otherwise fluidly communicate with a bypass annulus 202, which passes or extends around the turbine-compressor 114 and thereby allows at least a portion of the production stream 120 (FIG. 1) to circumvent the turbine-compressor 114. As illustrated, the turbine-compressor 114 may include a turbine 204 and a compressor 206. The turbine 204 may include an annular inlet 208, a plurality of rotary vanes 210 mounted on a rotatable shaft 212, a plurality of stationary vanes 214, and an annular outlet 216. The compressor 206 may include a gas inlet 218, a plurality of rotary vanes 220 mounted on the opposing end of the shaft 212, and an annular gas outlet 222. In the illustrated embodiment, the compressor 206 is depicted as a two-stage compressor, but could alternatively comprise a one-stage compressor or include more than two stages, without departing from the scope of the disclosure.

With continued reference to both FIGS. 1 and 2, operation of the system 100 is now provided. In exemplary operation, the production stream 120 may originate from a subterranean formation below the production zone 104 and flow upward toward the surface. The production stream 120 may comprise a mixed gas-oil stream. As will be appreciated by those skilled in the art, most mixed oil-gas streams originating from subterranean formations will also include some produced water, and it is not uncommon for production streams to include solid particulate material, such as sand produced from the formation, rust, and other wellbore debris. Accordingly, as used herein, the term "production stream" refers to a fluid stream that includes components of oil, gas, and possibly some produced water and solid particulate material.

Prior to reaching the surface, the production stream 120 must pass through the system 100, commencing with the lower separator 112*a*. As the production stream 120 flows upward through the lower separator 112*a*, the auger flight 126 of the auger separator 122 may be configured to impart spin or swirl on the production stream 120, and thereby centrifugally force the heavier or more dense components (e.g., oil, water, solid particulates, etc.) to the outside of the auger separator 122. The less dense components of the production stream 120 (e.g., gas) remain near the center of the auger separator 122 at or near the central support 124. As the production stream 120 flows toward the upper end of separator housing 118, a higher density stream 224 (FIG. 2) including liquids and particulates may exit the separator housing 118 via the take-off slots 128 and subsequently flow upward and into the bypass annulus 202. Accordingly, the higher density stream 224 may bypass the turbine-compressor 114 by flowing through the bypass annulus 202, and thereby alleviate the erosive effects of such fluids and solids on the rotary vanes 210 of the turbine 204.

The remainder of the production stream 120 comprises a lower density stream 226 (FIG. 2), which substantially comprises a gas that flows upward near the center of the auger separator 122 and is conveyed into the annular inlet 208 of the turbine 204. Upon entering the turbine 206, the lower density stream 226 may be configured to impinge upon and urge the rotary vanes 210 to rotate, which serves to rotate the shaft 212 such that the rotary vanes 220 of the compressor 206 correspondingly rotate. The lower density stream 226 may then flow through the annular outlet 216 of the turbine 204 where it is recombined with the higher density stream 224 in the bypass annulus 202 to form a recombined production stream 228 (FIG. 2).

The recombined production stream 228, which is now essentially the original production stream 120 (FIG. 1), may continue in the bypass annulus 202 until locating the upper separator 112*b* (FIG. 1), which may include a gas inlet tube 130 (FIG. 1) and an auger flight 132 (FIG. 1) helically arranged thereon. As it flows upward through the upper separator 112*b*, the recombined production stream 228 is rotated and thereby centrifugally forces the heavier or more dense components (i.e., liquids and particulate material) radially outward, while a portion of the gas in the recombined production stream 228 will separate and remain at or near the gas inlet tube 130. The more dense components (i.e., liquids, particulate material and unseparated gas) may then flow upward to be produced at the surface.

The gas separated from the recombined production stream 228, however, eventually reaches the upper end of gas inlet tube 130 and may be drawn into and otherwise flow into the gas inlet tube 130 via one or more inlet ports 134 (FIG. 1) defined in the gas inlet tube 130 at its upper end. The gas then flows down through the gas inlet tube 130 as gas stream 230 (FIG. 2) and eventually enters the compressor 206 at the inlet 218 to be compressed. Following compression in the compressor 206, a compressed gas stream 232 exits the compressor 206 through the annular gas outlet 222 and may eventually locate and flow through one or more crossover ports 136 (two shown in FIG. 1). The crossover ports 136 may fluidly communicate with the annulus 138 (FIG. 1) defined between the body 110 and the casing string 106 axially between the upper and lower packers 116*a,b*. Once in the annulus 138, the compressed gas stream 232 may then be injected into the production zone 104 via the flow ports 108 defined in the casing 106.

The system 100 may prove advantageous in separating and compressing gases downhole. The system 100, however, may experience problems during the commencement or "startup" of production (either initially or after the well has been shut-in) due to surging of the production stream 120, which, in turn, is caused by alternating slugs of liquid and gas in the production stream 120. Such surging, if left unchecked, may seriously affect the operational life of the turbine 204. This surging tends to subside as the production rate increases and the production stream 120 becomes a more consistent mixture of the liquid and gas. Until the surging subsides, however, the turbine 204 may be damaged or otherwise adversely affected. Consequently, it may be desirable to bypass the turbine-compressor 114 during this start-up period. To accomplish this, according to embodiments of the present disclosure, the system 100 may further include a shuttle valve assembly 140 arranged axially uphole from the turbine-compressor 114.

Figure 3A:
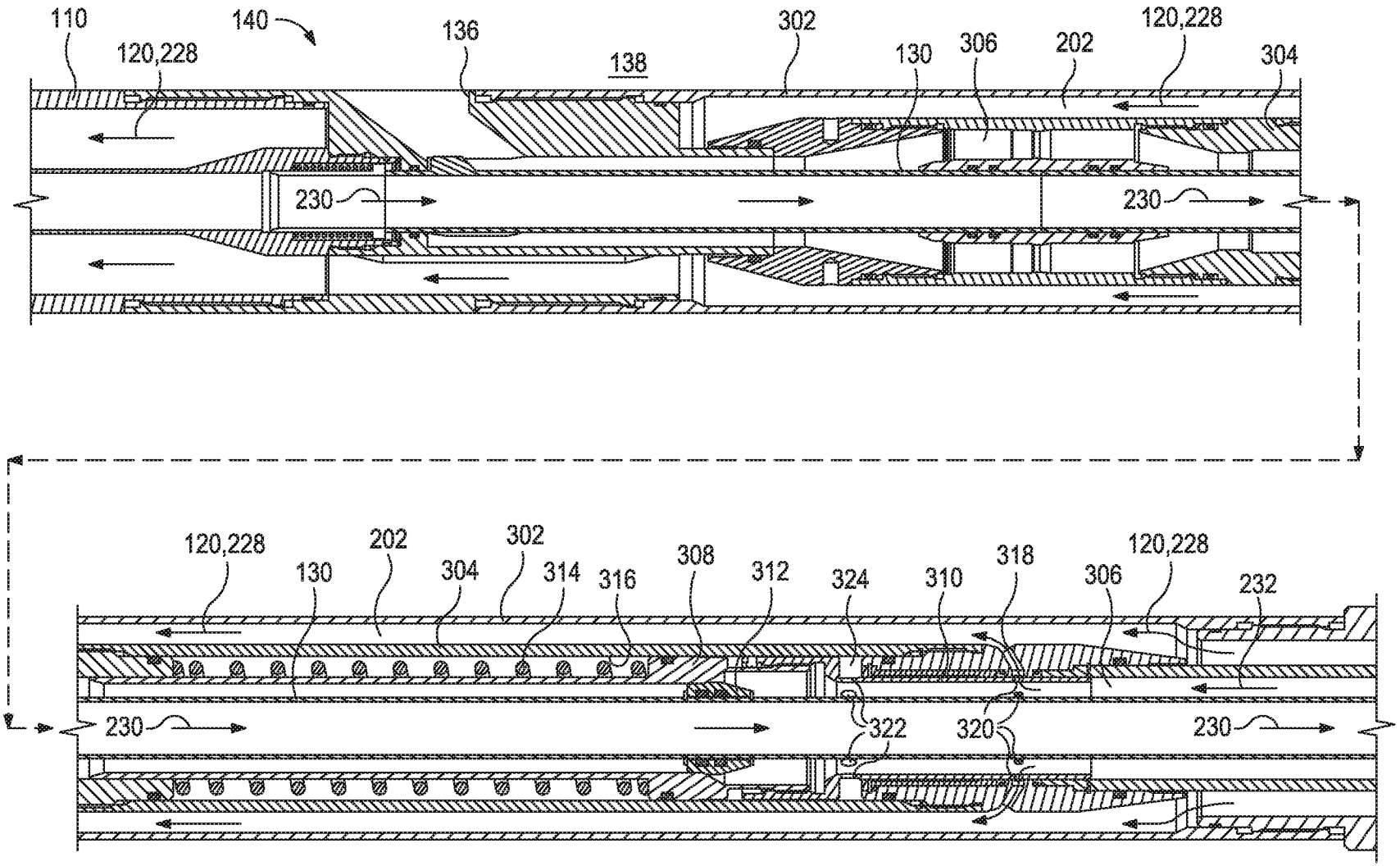
FIGS. 3A and 3B depict cross-sectional side views of an exemplary embodiment of the shuttle valve assembly of FIG. 1.
Figure 3B:
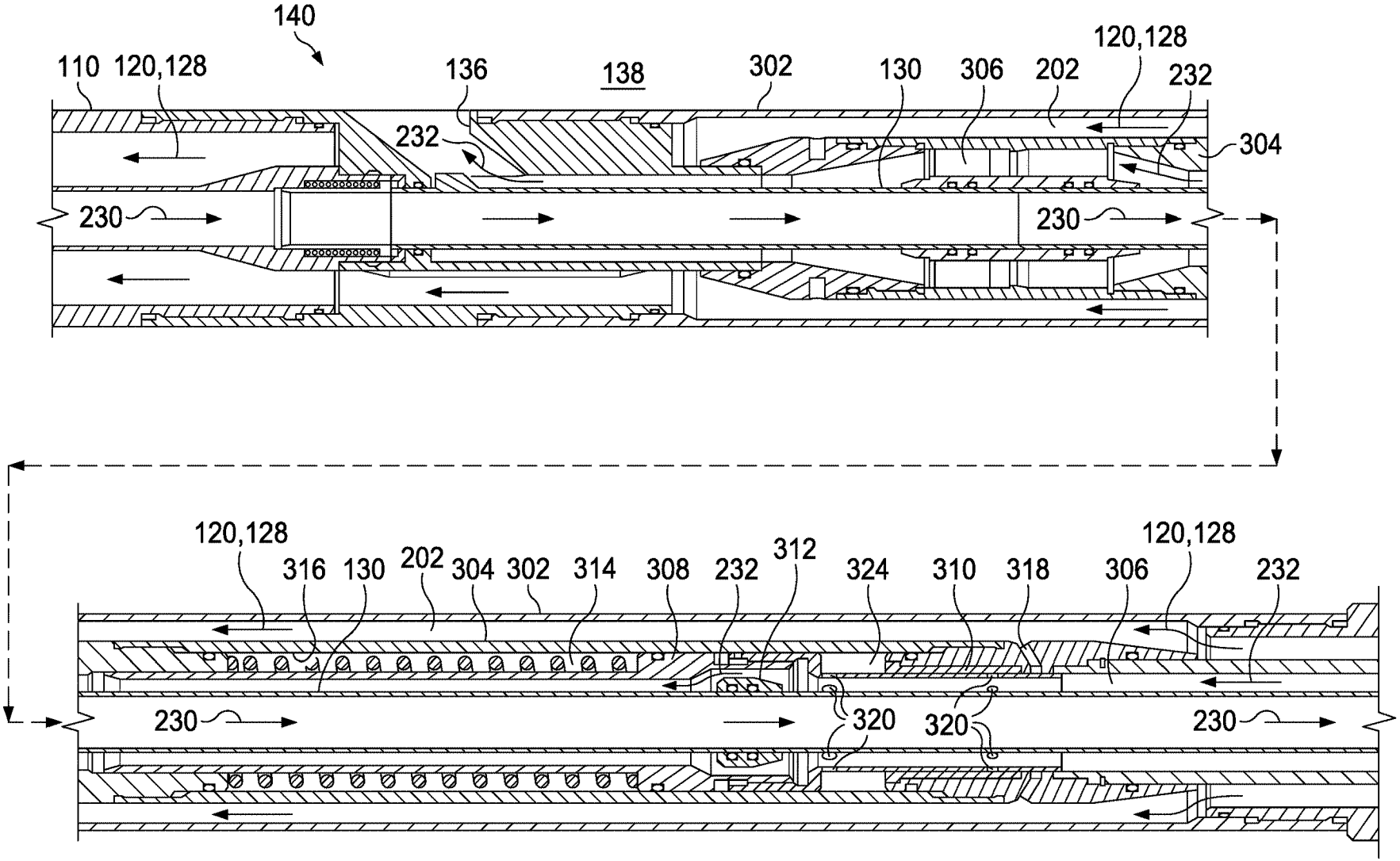

Referring now to FIGS. 3A and 3B, with continued reference to FIGS. 1 and 2, illustrated are cross-sectional side views of an exemplary embodiment of the shuttle valve assembly 140 of FIG. 1, according to one or more embodiments of the present disclosure. FIG. 3A depicts the shuttle valve assembly 140 in a first or circulation position, and FIG. 3B depicts the shuttle valve assembly 140 in a second or production position.

As illustrated, the shuttle valve assembly 140 (hereafter the "assembly 140") may include an elongate body 302, which may accommodate and otherwise concentrically receive therein a generally cylindrical mandrel assembly 304. As depicted, the mandrel assembly 304 may include several cylindrical component parts secured together to form a monolithic structure. The gas inlet tube 130 may extend concentrically within the mandrel assembly 304 and, as described above, may convey the gas stream 230 to the compressor 206 (FIG. 2) in a first or downhole direction (i.e., to the right in FIGS. 3A and 3B) from the upper separator 112*b* (FIG. 1). The body 302 and the mandrel assembly 304 may define and otherwise provide a portion of the bypass annulus 202 that extends between the turbine-compressor 114 (FIGS. 1 and 2) and the upper separator 112*b*. More particularly, the bypass annulus 202 in FIGS. 3A and 3B may convey the production stream 120 (i.e., the recombined production stream 228 of FIG. 2) from the turbine 204 (FIG. 2) to the upper separator 112*b* in a second or uphole direction (i.e., to the left in FIGS. 3A and 3B).

An inner annulus 306 may be defined between the gas inlet tube 130 and the mandrel assembly 304 and may be configured to convey the compressed gas stream 232 exiting the compressor 206 (FIG. 2) in the uphole direction. As described in more detail below, when the assembly 140 is in the circulation position (FIG. 3A), the compressed gas stream 232 may be directed and otherwise conveyed into the bypass annulus 202 to be recombined with the production stream 120. When the assembly 140 is in the production position (FIG. 3B), however, the compressed gas stream 232 may be conveyed into the annulus 138 via the crossover ports 136 to be subsequently injected into the production zone 104 (FIG. 1) via the flow ports 108 (FIG. 1) defined in the casing 106 (FIG. 1).

The assembly 140 may further include a piston 308, a shuttle valve 310, and a valve seat 312 secured to the gas inlet tube 130. The piston 308 may be movably arranged within the inner annulus 306 between a closed position, where the piston 308 abuts against and otherwise rests on the valve seat 312, as shown in FIG. 3A, and an open position, where the piston 308 is separated from the valve seat 312, as shown in FIG. 3B. With the piston 308 in the closed position, the compressed gas stream 232 flowing within the inner annulus 306 may be substantially prevented from flowing past the valve seat 312. Accordingly, when the piston 308 is in the closed position, the assembly 140 will be in the circulation position, and when the piston 308 is in the open position, the assembly 140 will be in the production position.

A biasing device 314 may be arranged within a piston chamber 316 cooperatively defined by the piston 308 and the mandrel assembly 304. The biasing device 314 may engage the piston 308 and may be configured to urge the piston 308 to the closed position. In some embodiments, the biasing device 314 may comprise a compression spring, as depicted. In other embodiments, however, the biasing device 314 may comprise any other type of device that may urge the piston 308 to the closed position.

The shuttle valve 310 may be operatively coupled to the piston 308 such that axial movement of the piston 308 within the inner annulus 306 correspondingly moves the shuttle valve 310 in the same direction. The mandrel assembly 304 may define and otherwise provide one or more circulation ports 318 and the shuttle valve 310 may define and otherwise provide one or more valve ports 320 alignable with the circulation ports 318 when the assembly 140 is in the circulation position. When the circulation and valve ports 318, 320 are aligned, as shown in FIG. 3A, the compressed gas stream 232 flowing in the inner annulus 306 may be able to flow into the bypass annulus 202 to be recombined with the production stream 120 (i.e., the recombined production stream 228). When the circulation and valve ports 318, 320 become misaligned, however, as shown in FIG. 3A, the compressed gas stream 232 is prevented from accessing the bypass annulus 202, and is instead conveyed past the valve seat 312 to the crossover ports 136 where it may be introduced into the annulus 138.

The shuttle valve 310 may further define and otherwise provide one or more piston ports 322 that provide fluid communication between the inner annulus 306 and a pressure cavity 324 cooperatively defined by the mandrel assembly 304 and the shuttle valve 310. As the speed of the compressor 206 (FIG. 2) increases, the pressure of the compressed gas stream 232 correspondingly increases and thereby pressurizes the pressure cavity 324. Increasing the pressure of the compressed gas stream 232 also places an axial load on exposed portions of the piston 308 at the valve seat 312. The hydraulic pressure of the compressed gas stream 232 may be converted into an axial load applied to the shuttle valve 310 and the piston 308 at the pressure cavity 324 and the exposed portions of the piston 308. As the pressure increases, the axial load assumed by the piston 208 (either directly or indirectly) will eventually overcome the spring force of the biasing device 314 to move the piston 308 from the closed position to the open position.

Exemplary operation of the assembly 140 is now provided. The well into which the assembly 140 may be conveyed is put into production by gradually opening one or more choke valves (not shown) at the surface. Opening the choke valves may allow the production stream 120 (FIG. 1) to start flowing through the system 100 (FIG. 1) and, more particularly, through the turbine-compressor 114 (FIGS. 1 and 2) to start the turbine 204 spinning. At startup, the turbine 204 and, therefore, the compressor 206 (FIG. 2) both spin at a low speed. As a result, the annular gas outlet 222 (FIG. 2) of the compressor 206 ejects the compressed gas stream 232 into the inner annulus 306 at a low pressure during startup. The pressure of the surrounding production zone 104 is fixed at a high pressure and, until the speed of the compressor 206 increases, the pressure of the compressed gas stream 232 cannot overcome the pressure differential between the production zone 104 and the compressor 206 for injection purposes.

Accordingly, at startup, the assembly 140 may be configured to be in the circulation position, where the piston 308 is biased against the valve seat 312 and the compressed gas stream 232 is thereby prevented from flowing past the valve seat 312 to the crossover ports 136. Rather, in the circulation position, the circulation and valve ports 318, 320 may be aligned to allow the compressed gas stream 232 flowing in the inner annulus 306 to enter the bypass annulus 202 to be recombined with the production stream 120 (i.e., the recombined production stream 228).

To move the assembly 140 from the circulation position to the production position, the pressure differential between the production zone 104 and the compressor 206 must be overcome. To accomplish this, the speed of the compressor 206 (FIG. 2) must increase to correspondingly increase the pressure of the compressed gas stream 232, which acts on the piston 308 within the pressure cavity 324 and also on the exposed portions of the piston 308. The hydraulic pressure of the compressed gas stream 232 is converted into an axial load applied to the piston 308 in the uphole direction. As the pressure of the compressed gas stream 232 increases, the axial load assumed by the piston 208 (either directly or indirectly) will eventually overcome the spring force of the biasing device 314 to move the piston 308 from the closed position (FIG. 3A) to the open position (FIG. 3B).

As will be appreciated, the total surface area of the piston 308 exposed to the compressed gas stream 232 may be optimized in conjunction with the spring force of the biasing device 314 such that the piston 308 moves to the open position only after the pressure of the compressed gas stream 232 is equal to or greater than the pressure of the production zone 104 (FIG. 1). In other words, the assembly 140 may be configured to remain in the circulation position until the compressed gas stream 232 is sufficiently pressurized to overcome the pressure of the production zone 104, and thereby allow the compressed gas stream 232 to be injected into production zone 104.

Moving the piston 308 from the closed position to the open position correspondingly moves the shuttle valve 310 such that the circulation and valve ports 318, 320 become misaligned, which prevents the compressed gas stream 232 from accessing the bypass annulus 202. Instead, the compressed gas stream 232 may be conveyed past the valve seat 312 to the crossover ports 136 where it may be introduced into the annulus 138. As described above, once reaching the annulus 138, the compressed gas stream 232 may subsequently be injected into the production zone 104 (FIG. 1) via the flow ports 108 (FIG. 1) defined in the casing 106 (FIG. 1).

Embodiments disclosed herein include:

A. A gas separation and injection system that includes a lower separator that receives and separates a production stream into a higher density stream and a lower density stream, a turbine-compressor including a turbine and a compressor, the turbine being positioned to receive the lower density stream to rotate a shaft that drives the compressor and subsequently recombine the lower and higher density streams to form a recombined production stream, an upper separator that receives the recombined production stream via a bypass annulus and includes a gas inlet tube that conveys a gas stream to the compressor to produce a compressed gas stream, and a shuttle valve assembly axially interposing the upper separator and the turbine-compressor. The shuttle valve assembly including a mandrel assembly received within an elongate body and having the gas inlet tube extending within the mandrel assembly, wherein the elongate body and the mandrel assembly define at least a portion of the bypass annulus, and an inner annulus is defined between the gas inlet tube and the mandrel assembly to receive the compressed gas stream from the compressor, a valve seat secured to the gas inlet tube, a piston movably arranged within the inner annulus between a closed position, where the piston rests on the valve seat and prevents the compressed gas stream from bypassing the valve seat, and an open position, where the piston is separated from the valve seat, and a shuttle valve operatively coupled to the piston such that axial movement of the piston correspondingly moves the shuttle valve.

B. A method that includes opening a choke valve to commence flow of a production stream in a wellbore and receiving the production stream at a lower separator, separating the production stream into a higher density stream and a lower density stream with the lower separator and receiving the lower density stream in a turbine to rotate a shaft that drives a compressor, recombining the lower and higher density streams to form a recombined production stream, and receiving the recombined production stream at an upper separator via a bypass annulus and conveying a gas stream to the compressor via a gas inlet tube to produce a compressed gas stream. A shuttle valve assembly axially interposes the upper separator and the compressor and includes a mandrel assembly received within an elongate body and having the gas inlet tube extending within the mandrel assembly, wherein the elongate body and the mandrel assembly define at least a portion of the bypass annulus, and an inner annulus is defined between the gas inlet tube and the mandrel assembly, a valve seat secured to the gas inlet tube, a piston movably arranged within the inner annulus, and a shuttle valve operatively coupled to the piston such that axial movement of the piston correspondingly moves the shuttle valve. The method further including receiving the compressed gas stream in the inner annulus, and increasing a pressure of the compressed gas stream to move the piston from a closed position, where the piston rests on the valve seat and prevents the compressed gas stream from bypassing the valve seat, and an open position, where the piston is separated from the valve seat.

C. A shuttle valve assembly that includes a body having a gas inlet tube extending therein from an upper separator, a mandrel assembly radially interposing the body and the gas inlet tube, wherein the body and the mandrel assembly define at least a portion of a bypass annulus that extends around a turbine-compressor and between a lower separator and the upper separator, an inner annulus defined between the gas inlet tube and the mandrel assembly to receive a compressed gas stream from a compressor of the turbine-compressor, a valve seat secured to the gas inlet tube, a piston movably arranged within the inner annulus between a closed position, where the piston rests on the valve seat and prevents the compressed gas stream from bypassing the valve seat, and an open position, where the piston is separated from the valve seat, and a shuttle valve operatively coupled to the piston such that axial movement of the piston correspondingly moves the shuttle valve.

Each of embodiments A, B, and C may have one or more of the following additional elements in any combination: Element 1: further comprising one or more circulation ports defined in the mandrel assembly, and one or more valve ports defined in the shuttle valve, wherein, when the piston is in the closed position, the circulation and valve ports are aligned and the compressed gas stream flows from the inner annulus into the bypass annulus to be mixed with the recombined production stream. Element 2: wherein, when the piston is in the open position, the circulation and valve ports become misaligned and the compressed gas stream is conveyed past the valve seat to one or more crossover ports defined in the body. Element 3: further comprising one or more piston ports defined in the shuttle valve, and a pressure cavity cooperatively defined by the mandrel assembly and the shuttle valve and in fluid communication with the inner annulus via the one or more piston ports, wherein the pressure cavity is pressurized with the compressed gas stream to move the piston from the closed position to the open position. Element 4: further comprising a biasing device arranged within a piston chamber cooperatively defined by the piston and the mandrel assembly, wherein the biasing device engages and urges the piston to the closed position. Element 5: wherein a pressure of the compressed gas stream places an axial load on the piston to overcome a spring force of the biasing device. Element **6*a*: wherein the biasing device is a compression spring. Element 6*b***: wherein the gas separation and injection system is arranged in a wellbore and the production stream originates from a subterranean formation adjacent the wellbore.

Element 7: wherein the mandrel assembly defines one or more circulation ports and the shuttle valve defines one or more valve ports, the method further comprising aligning the circulation and valve ports with the piston in the closed position, and flowing the compressed gas stream from the inner annulus into the bypass annulus via the circulation and valve ports to be mixed with the recombined production stream. Element 8: further comprising moving the piston to the open position where the circulation and valve ports become misaligned, and conveying the compressed gas stream past the valve seat to one or more crossover ports defined in the body. Element 9: further comprising introducing the compressed gas stream into an annulus defined between a body that houses the shuttle valve assembly and a casing string lining the wellbore, and injecting the compressed gas stream into a surrounding production zone via one or more flow ports defined in the casing. Element 10: wherein increasing the pressure of the compressed gas stream to move the piston from the closed position to the open position comprises overcoming a pressure differential between the surrounding production zone and an outlet of the compressor. Element 11: wherein one or more piston ports are defined in the shuttle valve and a pressure cavity is cooperatively defined by the mandrel assembly and the shuttle valve and fluidly communicates with the inner annulus via the one or more piston ports, wherein increasing the pressure of the compressed gas stream comprises increasing the pressure of the compressed gas stream within the pressure cavity, and applying an axial load on the piston with the compressed gas stream to move the piston from the closed position to the open position. Element 12: further comprising applying the axial load on exposed portions of the piston with the compressed gas stream to move the piston from the closed position to the open position. Element 13: further comprising engaging and urging the piston to the closed position with a biasing device arranged within a piston chamber cooperatively defined by the piston and the mandrel assembly, and overcoming a spring force of the biasing device with the axial load on the piston.

Element 14: further comprising one or more circulation ports defined in the mandrel assembly, and one or more valve ports defined in the shuttle valve, wherein, when the piston is in the closed position, the circulation and valve ports are aligned and the compressed gas stream flows from the inner annulus into the bypass annulus to be mixed with a recombined production stream. Element 15: wherein, when the piston is in the open position, the circulation and valve ports become misaligned and the compressed gas stream is conveyed past the valve seat to one or more crossover ports defined in the body. Element 16: further comprising one or more piston ports defined in the shuttle valve, and a pressure cavity cooperatively defined by the mandrel assembly and the shuttle valve and in fluid communication with the inner annulus via the one or more piston ports, wherein the pressure cavity is pressurized with the compressed gas stream to move the piston from the closed position to the open position. Element 17: further comprising a biasing device arranged within a piston chamber cooperatively defined by the piston and the mandrel assembly, wherein the biasing device engages and urges the piston to the closed position. Element 18: wherein a pressure of the compressed gas stream places an axial load on the piston to overcome a spring force of the biasing device.

By way of non-limiting example, exemplary combinations applicable to A, B, and C include: Element 1 with Element 2; Element 3 with Element 4; Element 4 with Element 5; Element 4 with Element 6; Element 7 with Element 8; Element 8 with Element 9; Element 9 with Element 10; Element 11 with Element 12; Element 11 with Element 13; Element 14 with Element 15; Element 16 with Element 17; and Element 17 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A gas separation and injection system, comprising:

a lower separator that separates a production stream into a higher density stream and a lower density stream;

a turbine-compressor including a turbine positioned to receive the lower density stream to rotate a shaft that drives a compressor and subsequently recombine the lower and higher density streams to form a recombined production stream;

an upper separator that receives the recombined production stream via a bypass annulus and includes a gas inlet tube that conveys a gas stream to the compressor to produce a compressed gas stream; and a shuttle valve assembly entirely positioned uphole from the turbine-compressor, and axially interposing the upper separator and the turbine-compressor, the shuttle valve assembly comprising:

a mandrel assembly received within a body and having the gas inlet tube extending within the mandrel assembly, wherein the body and the mandrel assembly define at least a portion of the bypass annulus, and an inner annulus is defined between the gas inlet tube and the mandrel assembly to receive the compressed gas stream from the compressor;

a valve seat secured to the gas inlet tube;

a piston movably arranged within the inner annulus between a closed position, where the piston rests on the valve seat and prevents the compressed gas stream from bypassing the valve seat, and an open position, where the piston is separated from the valve seat; and a shuttle valve operatively coupled to the piston such that axial movement of the piston correspondingly moves the shuttle valve.

2. The system of claim 1, further comprising:

one or more circulation ports defined in the mandrel assembly; and one or more valve ports defined in the shuttle valve, wherein, when the piston is in the closed position, the circulation and valve ports are aligned and the compressed gas stream flows from the inner annulus into the bypass annulus to be mixed with the recombined production stream.

3. The system of claim 2, wherein, when the piston is in the open position, the circulation and valve ports become misaligned and the compressed gas stream is conveyed past the valve seat to one or more crossover ports defined in the body.

4. The system of claim 1, further comprising:

one or more piston ports defined in the shuttle valve; and a pressure cavity cooperatively defined by the mandrel assembly and the shuttle valve and in fluid communication with the inner annulus via the one or more piston ports, wherein the pressure cavity is pressurized with the compressed gas stream to move the piston from the closed position to the open position.

5. The system of claim 4, further comprising a biasing device arranged within a piston chamber cooperatively defined by the piston and the mandrel assembly, wherein the biasing device engages and urges the piston to the closed position.

6. The system of claim 5, wherein a pressure of the compressed gas stream places an axial load on the piston to overcome a spring force of the biasing device.

7. The system of claim 5, wherein the biasing device is a compression spring.

8. A method, comprising:

opening a choke valve to commence flow of a production stream in a wellbore and receiving the production stream at a lower separator;

separating the production stream into a higher density stream and a lower density stream with the lower separator and receiving the lower density stream in a turbine to rotate a shaft that drives a compressor;

recombining the lower and higher density streams to form a recombined production stream;

receiving the recombined production stream at an upper separator via a bypass annulus and conveying a gas stream to the compressor via a gas inlet tube to produce a compressed gas stream, wherein a shuttle valve assembly is entirely positioned uphole from the turbine-compressor, and axially interposes the upper separator and the compressor, the shuttle valve assembly includes:

a mandrel assembly received within a body and having the gas inlet tube extending within the mandrel assembly, wherein the body and the mandrel assembly define at least a portion of the bypass annulus, and an inner annulus is defined between the gas inlet tube and the mandrel assembly;

a valve seat secured to the gas inlet tube;

a piston movably arranged within the inner annulus; and a shuttle valve operatively coupled to the piston such that axial movement of the piston correspondingly moves the shuttle valve;

receiving the compressed gas stream in the inner annulus; and increasing a pressure of the compressed gas stream to move the piston from a closed position, where the piston rests on the valve seat and prevents the compressed gas stream from bypassing the valve seat, and an open position, where the piston is separated from the valve seat.

9. The method of claim 8, wherein the mandrel assembly defines one or more circulation ports and the shuttle valve defines one or more valve ports, the method further comprising:

aligning the circulation and valve ports with the piston in the closed position; and flowing the compressed gas stream from the inner annulus into the bypass annulus via the circulation and valve ports to be mixed with the recombined production stream.

10. The method of claim 9, further comprising:

moving the piston to the open position where the circulation and valve ports become misaligned; and conveying the compressed gas stream past the valve seat to one or more crossover ports defined in the body.

11. The method of claim 10, further comprising:

introducing the compressed gas stream into an annulus defined between another body that houses the shuttle valve assembly and a casing string lining the wellbore; and injecting the compressed gas stream into a surrounding production zone via one or more flow ports defined in the casing.

12. The method of claim 11, wherein increasing the pressure of the compressed gas stream to move the piston from the closed position to the open position comprises overcoming a pressure differential between the surrounding production zone and an outlet of the compressor.

13. The method of claim 8, wherein one or more piston ports are defined in the shuttle valve and a pressure cavity is cooperatively defined by the mandrel assembly and the shuttle valve and fluidly communicates with the inner annulus via the one or more piston ports, wherein increasing the pressure of the compressed gas stream comprises:

increasing the pressure of the compressed gas stream within the pressure cavity; and applying an axial load on the piston with the compressed gas stream to move the piston from the closed position to the open position.

14. The method of claim 13, further comprising applying the axial load on exposed portions of the piston with the compressed gas stream to move the piston from the closed position to the open position.

15. The method of claim 13, further comprising:

engaging and urging the piston to the closed position with a biasing device arranged within a piston chamber cooperatively defined by the piston and the mandrel assembly; and overcoming a spring force of the biasing device with the axial load on the piston.

16. A shuttle valve assembly, comprising:

a body having a gas inlet tube extending therein from an upper separator;

a mandrel assembly radially interposing the body and the gas inlet tube, wherein the body and the mandrel assembly define at least a portion of a bypass annulus that extends around a turbine-compressor and between a lower separator and the upper separator;

an inner annulus defined between the gas inlet tube and the mandrel assembly to receive a compressed gas stream from a compressor of the turbine-compressor;

a valve seat secured to the gas inlet tube;

a piston movably arranged within the inner annulus between a closed position, where the piston rests on the valve seat and prevents the compressed gas stream from bypassing the valve seat, and an open position, where the piston is separated from the valve seat; and a shuttle valve that is entirely positioned uphole from the turbine-compressor, and operatively coupled to the piston such that axial movement of the piston correspondingly moves the shuttle valve.

17. The shuttle valve assembly of claim 16, further comprising:

one or more circulation ports defined in the mandrel assembly; and one or more valve ports defined in the shuttle valve, wherein, when the piston is in the closed position, the circulation and valve ports are aligned and the compressed gas stream flows from the inner annulus into the bypass annulus to be mixed with a recombined production stream.

18. The shuttle valve assembly of claim 17, wherein, when the piston is in the open position, the circulation and valve ports become misaligned and the compressed gas stream is conveyed past the valve seat to one or more crossover ports defined in the body.

19. The shuttle valve assembly of claim 16, further comprising:

one or more piston ports defined in the shuttle valve; and a pressure cavity cooperatively defined by the mandrel assembly and the shuttle valve and in fluid communication with the inner annulus via the one or more piston ports, wherein the pressure cavity is pressurized with the compressed gas stream to move the piston from the closed position to the open position.

20. The shuttle valve assembly of claim 19, further comprising a biasing device arranged within a piston chamber cooperatively defined by the piston and the mandrel assembly, wherein the biasing device engages and urges the piston to the closed position.

21. The shuttle valve assembly of claim 20, wherein a pressure of the compressed gas stream places an axial load on the piston to overcome a spring force of the biasing device.

* * * * *